US005327660A

United States Patent [19]

Emory

[11] Patent Number: 5,327,660

[45] Date of Patent: Jul. 12, 1994

[54] DRUM DRYING OF ACRYLONITRILE PRODUCTION WASTES

[76] Inventor: John W. Emory, 18337 Fern Canyon, Strongsville, Ohio 44136

[21] Appl. No.: 624,833

[22] Filed: Dec. 10, 1990

[51] Int. Cl.[5] ..... F26B 5/06

[52] U.S. Cl. ..... 34/290; 34/112

[58] Field of Search ..... 34/110, 112, 113, 5, 34/92

[56] References Cited

U.S. PATENT DOCUMENTS

| | | | |
|---|---|---|---|
| 1,501,514 | 7/1924 | Boberg | 34/112 |
| 2,034,599 | 3/1936 | Van Marle | 34/112 |
| 2,771,689 | 11/1956 | Bettes, Jr. | 34/112 |
| 2,923,979 | 2/1960 | Kalil | 34/112 |
| 3,068,585 | 12/1962 | Overton | 34/112 |
| 3,145,130 | 8/1964 | Wygasch et al. | 34/112 |
| 3,166,464 | 1/1965 | Eolkin | 34/110 |
| 3,363,665 | 1/1968 | Daane et al. | 34/112 |
| 3,905,122 | 9/1975 | Ohshima et al. | 34/17 |
| 4,189,343 | 2/1980 | Overton | 34/113 |

OTHER PUBLICATIONS

Arun S. Mujumdar; "Handbook of Industrial Drying"; pp. 227-242; McGill University, Montreal, Quebec, Canada.

Abstract 02133605, David L. Russell and David A. Smith Title: Thermal Sludge Drying—A Look at Drum Dryer Systems.

*Primary Examiner*—Henry A. Bennett

*Assistant Examiner*—Denise L. Gromada

[57] ABSTRACT

A process for deliquifying a solid particulate containing liquid waste stream including organic contaminants produced during the production of acrylonitrile comprising feeding the waste stream onto the outer surface of a heated drum(s) rotating the drum(s) to facilitate removal of the liquid to produce a substantially solid material which adheres to the surface of the drum(s) and is subsequently removed.

6 Claims, 1 Drawing Sheet

DRUM DRYING OF ACRYLONITRILE PRODUCTION WASTES

BACKGROUND OF INVENTION

The present invention is related to the use of a drum dryer for deliquification of acrylonitrile production waste. In particular, the present invention is related to the use of a drum dryer for deliquification of acrylonitrile waste streams produced during the practice of the Sohio Acrylonitrile Process.

The problem of minimization of waste products produced in any chemical processing plant is becoming acute due to environmental as well as disposal problems. In the practice of the Sohio Acrylonitrile Process the production of liquid waste streams containing solid particulate material is a problem because conventional means of disposing of these streams is becoming more and more expensive. Accordingly, minimization of the volume of these streams is desirable. Typically, mechanical dewatering equipment such as a centrifuge or filter have been utilized to deliquify these waste streams to reduce their volume. Solid bearing waste streams from the commercial acrylonitrile plant are typically sent to a primary solid-liquid separation device for an initial phase separation. In this device the solids are concentrated into a slurry stream containing between about 7 to 40 percent solids. This stream is then mechanically dewatered using either a centrifuge or filter press to produce a sludge cake containing between about 30 to 60 percent solids. The liquid recovered during the mechanical separation is recycled back to the primary phase separation device or disposed of directly.

It would be highly desirable to process this sludge cake in a economic and efficient manner to further concentrate the solid material. However, until the present invention the inherent nature of the sludge cake has made further processing uneconomical or impossible.

SUMMARY OF THE INVENTION

It is the primary object of the present invention to provide a process for deliquifying and drying a solid containing liquid waste stream produced during the production of acrylonitrile.

It is the further object of the present invention to provide a process for the concentration of the solid material present in the solid containing liquid waste stream produced during the production of acrylonitrile.

Additional objects, advantages and novel features of the invention will be set forth in part in the description as follows and in part will become apparent to those skilled in the art upon examination of the following or may be learned by practice of the invention. The objects and advantages of the invention may be realized and obtained by means of the instrumentalities and combinations particularly pointed out in the appending claims.

To achieve the foregoing and other objects and in accordance with the purpose of the present invention, as embodied and broadly described herein, the process of deliquifying a waste stream containing solid particulate material and organic contaminants produced during the production of acrylonitrile to form a substantially solid waste product comprises feeding the waste stream containing solid particulate matter and organic contaminants into a dryer onto the outer surface of a heated drum(s), rotating the drum(s) to facilitate the removal of the liquid from the waste stream enabling the nonvolatile organic contaminants in waste stream to form a tacky substantially solid material including the particulate material which adheres to the outer surface of the drum(s), and removing the substantially dried solid material from the outer surface of the heated drum(s).

The temperature at which the drum surface is heated is not particularly critical provided that it is sufficiently high enough to permit the organic polymer to become tacky as well as facilitates easy removal of the liquid present in the waste stream via evaporation. Preferably, the drum(s) is heated to a temperature substantially the same as or above the boiling point of the liquid present in the waste stream to allow evaporation of the liquid to take place quickly.

In a further aspect of the present invention, the process for removal and concentration of the solid particulate material present in a substantial liquid waste streams obtained during the manufacture of acrylonitrile comprises feeding a hydrocarbon (preferably propylene), ammonia and an oxygen containing gas over an ammoxidation catalyst at an elevated temperature to produce crude acrylonitrile (acrylonitrile containing organic and inorganic impurities), contacting the crude acrylonitrile with a liquid (e.g., water) to separate the solid particulate material and organic contaminants from the acrylonitrile, feeding the liquid stream containing the solid particulate material and organic contaminants into a dryer onto the outer surface of a heated drum(s), rotating the drum(s) to facilitate removal of the liquid from the waste stream causing the organic contaminants to form a tacky solid material including the solid particles which adheres to the outer surface of the heated drum(s) and removing the solid tacky material from the outer surface of the heated drum(s).

The Sohio Acrylonitrile Process for the manufacture of acrylonitrile is well known in the art. For details as to the procedure for manufacturing acrylonitrile see Kirk Othmer, Vol. 1, pages 414–426 (1978) herein incorporated by reference.

The present invention uses a drum dryer in a novel manner to thermally deliquify and dry a solid particulate (e.g. catalyst fines) containing waste stream also having organic contaminants (e.g., polymers) produced during the primary phase separation of the waste stream of an acrylonitrile plant. The drum dryer apparatus utilized during the practice of the process of the present invention utilizes the discovery that the organic contaminants present in the solid containing waste stream obtained during the production of acrylonitrile pass through a tacky or sticky phase during processing which prohibits the use of conventional thermal sludge dryers such as screw or rotary types because this tacky material quickly clogs these dryers making them inoperative. The drum dryer utilized in the practice of the invention has been found to be uniquely suitable for treatment of acrylonitrile waste streams because the solid containing waste stream passes through a sticky phase enabling it to stick to and coat the drum outer surface producing a dry cake that is eventually scraped off the drum surface by mechanical means such as knife blades. It is applicants discovery that not only do the organic contaminants present in the acrylonitrile waste streams containing solid particles pass through a sticky phase during deliquification, but this tacky material captures the solid particulates present in the waste stream making the use of a drum dryer uniquely suitable for the deliquification of an acrylonitrile waste stream because it simultaneous removes the solid particulates and the organic cantaminants.

Another advantage of the present invention is that the dried substantial solid waste product obtained by the practice of the present invention has a moisture content far less than the moisture content of the cake obtained from mechanical dewatering procedure (e.g., 80 to 100% solids by weight vs. 45 to 60% solids by weight). This results in substantially easier handling of the product during subsequent disposal procedures. Moreover, the fact that the waste produce has a much higher solid content gives the product a much higher heating value (e.g. BTU/lbs) thereby making the waste product attractive as a source of solid fuel for industrial boilers.

BRIEF DESCRIPTION OF THE DRAWINGS

The accompanying drawing, which is incorporated and forms a part of the specification, illustrates an embodiment of the present invention, and together with the descriptions serves to explain the principles of the invention.

Figure 1:
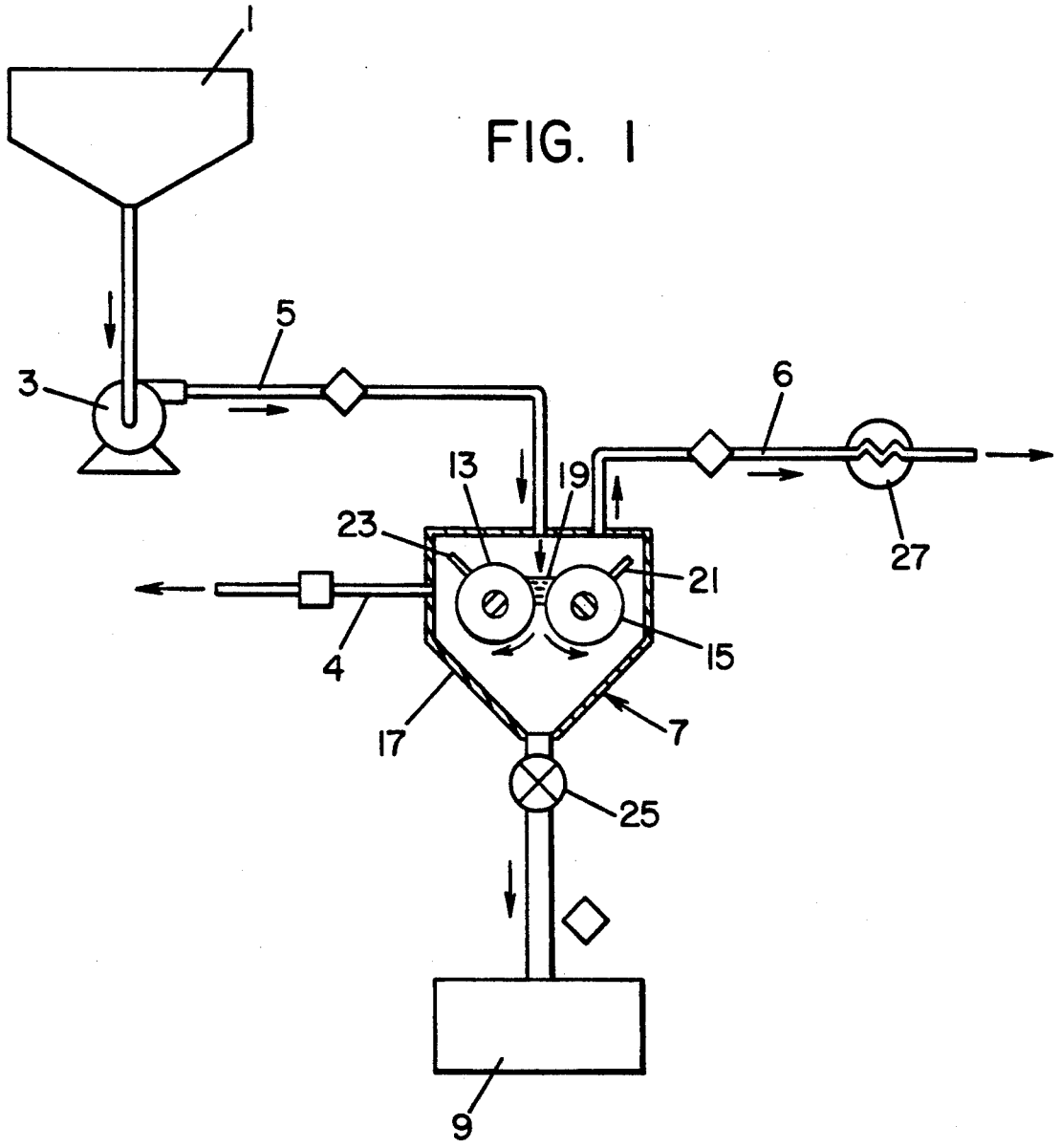
FIG. 1 is a schematic view of the process of the present invention.

Reference will now be made in detail to the present preferred embodiment of the invention, an example which is illustrated in the accompanying drawing.

DETAILED DESCRIPTION OF THE INVENTION

With reference to the FIGURE the process of the present invention will now be described in detail. The solids containing waste stream obtained from the quench column of an acrylonitrile plant is fed to quench water clarifier 1 for primary solid-liquid separation. Quench water clarifier 1 does not form a part of this invention and has been used in commercial acrylonitrile processes for initial phase separation of the quench water obtained form the quench column of commercial acrylonitrile plants. The solids concentration of the slurry stream from the bottom of clarifier 1 after phase separation in clarifier 1 is anywhere between 5 to 40 weight percent solids.

The slurry stream obtained from clarifier 1 is passed through pump 3 via line 5 directly into drum dryer 7 for deliquification of the solid slurry stream containing organic polymer material.

The drum dryer 7 is a commercially available unit such as that disclosed in U.S. Pat. No. 4,189,343 or 3,068,585 herein incorporated by reference.

For purposes of illustration only drum dryer 7 shown in the FIGURE is a double drum vacuum dryer comprising two stainless steel chrome plated drums 13 and 15, respectively, housed in a vacuum tight steel enclosure 17. The drums are heated on the inside by steam or other heat transfer medium. The solid containing waste stream is fed to the outside of drums 13 and 15 in the nip area formed between drums 13 and 15. A small pool of slurry material 19 is maintained in the nip area by the drums 13 and 15. As drums 13 and 15 rotate, the liquid in the waste stream is evaporated and a thin film of solid material (not shown) is formed on the drum surface. Stationary knives 21 and 23 located adjacent, preferably in contact with, the surface of drums 15 and 17, respectively, scrape the dried solids off the drum surfaces.

The dried solids are discharged from the drum dryer by means of rotary valves or a lock hopper 25 into dumpster box 9 for further treatment or disposal. The evaporated vapors present in vacuum steel enclosure 17 can be recycled directly to quench water clarifier 1 via line 4 or they can be sent via line 6 to a conventional condenser 27 condensed to form a liquid which can then recycled back to quench water clarifier 1.

Any noncondensible vapors from condenser 27 can be sent back to the quench water clarifier if the clarifier is equipped with a vapor control system (not shown) or to a separate vapor handling system (not shown). Typically, a vacuum pump (not shown) or blower (not shown) is used to create a vacuum on the drum dryer system to collect the evaporated water and volatile organics and to prevent vapor emissions from the dryer and associated processing equipment. Neither the vapor handling system, vacuum pump or blower form any part of the process of the present invention.

The substantially solid material adhering to the surface of the drum dryer eventually dries to a solid-like material having a solid concentration of greater than 65 weight percent solids, typically between about 80 to 100 weight percent solids. This high solids concentration waste material significantly reduces the overall volume of solid waste material requiring further treatment and/or disposal. Of course, reducing the volume of solid waste material lowers the cost associated with the treatment and/or disposal of this material. Also, depending on the organic nature of the solid material, the product material from the drum dryer may have a high enough heating value for use as a supplemental fuel (e.g. 4000–5000 BTU/lb). In addition, the process of the present invention allows for recovery of valuable organics for recycle into the acrylonitrile process.

The following examples are set forth in Table 1 below for purposes of illustration only. The procedure outlined above was followed utilizing two waste feeds.

TABLE 1

| | Example 1 | Example 2 |
|---|---|---|
| Drum Dyer | Double drum 6" × 8" | Vaccum double drum 12" × 18" |
| Feed Material | 26% solid 74% liquid | 30% solid 70% liquid |
| Dried Material | 95% solid | 85% solid |
| Heating Medium | 98 psig saturated stream | 85 psig saturated stream |
| Drum Speed | 2.9 RPM | 1.5 RPM |
| Gross Mass Reduction | 73% | 65% |
| Evaporation Rate | | 6.1 lb/hr-ft2 |

The forgoing description of the preferred embodiment of the invention has been presented for purposes of illustration and description. It is not intended to be exhausted or to limit the invention to the precise form disclosed, and obviously many modifications and variations are possible in light of the above teaching. The embodiment was chosen and described in order to best describe the principles of the invention and is practical application to thereby enable others skilled in the art to best utilize the invention in various embodiments and with various modifications as are suitable to the particular use contemplated. It is intended that the scope of the invention be defined by the claims appended hereto.

What is claimed is:

1. A process of deliquifying a waste stream containing solid inorganic particulate material and organic polymer contaminants obtained during the production of acrylonitrile to produce a substantially solid waste product comprising feeding the particulate containing waste stream including organic polymer contaminants into a dryer onto the outer surface of at least one heated drum, rotating said drum to facilitate removal of the liquid from said waste stream enabling the organic polymer contaminants present in the waste stream to form a tacky substantially solid material containing the particulate material which adheres to the surface of the drum, and removing the tacky solid material from the surface of the drum to obtain the solid waste product.

2. A process of claim 1 wherein the process is performed in a substantially continuous manner by feeding said waste stream onto the outer surface of said heated drum at a rate substantially equal to the rate of removal of said solid waste product from the drum surface.

3. The process of claim 1 wherein the removal of the tacky solid material is performed by positioning a scraping blade adjacent to the surface of the drum dryer.

4. The process of claim 1 wherein the outer surface of said drum dryer is maintained at a temperature at least substantially the same as the boiling point of said liquid present in said waste stream.

5. The process of claim 1 wherein the drum dryer comprises a set of two drums positioned in a vacuum chamber.

6. The process of claim 5 wherein the waste stream is fed to the outside surface of the two drums at the nip area.

* * * * *